US006186416B1

(12) United States Patent
Jones

(10) Patent No.: US 6,186,416 B1
(45) Date of Patent: Feb. 13, 2001

(54) SPRINKLER TRIM RING

(75) Inventor: Curtis M. Jones, Largo, FL (US)

(73) Assignee: Brady Products Incorporated, Clearwater, FL (US)

( * ) Notice: Under 35 U.S.C. 154(b), the term of this patent shall be extended for 0 days.

(21) Appl. No.: 09/497,622

(22) Filed: Feb. 3, 2000

(51) Int. Cl.[7] ..... B05B 1/28

(52) U.S. Cl. ..... 239/288.5; 239/201; 239/203; 239/288

(58) Field of Search ..... 239/200–206, 239/276, 288, 288.5, 288.3

(56) References Cited

U.S. PATENT DOCUMENTS

| | | | | |
|---|---|---|---|---|
| 2,751,250 | | 6/1956 | Block | 299/60 |
| 2,756,099 | * | 7/1956 | Reynolds, Jr. | 239/205 |
| 3,015,448 | | 1/1962 | Hurless | 239/201 |
| 3,117,724 | * | 1/1964 | Ray | 239/205 |
| 3,266,730 | * | 8/1966 | Martini | 239/205 |
| 3,650,478 | * | 3/1972 | Jones | 239/201 X |
| 3,655,132 | * | 4/1972 | Rosic | 239/206 |
| 3,762,642 | | 10/1973 | Di Santo | 239/201 |
| 3,874,588 | * | 4/1975 | Flynn | 239/206 X |
| 3,904,120 | | 9/1975 | Sbicca | 239/201 |
| 3,934,820 | * | 1/1976 | Phaup | 239/205 |
| 4,582,256 | * | 4/1986 | Jaquez | 239/288.5 |
| 4,781,327 | * | 11/1988 | Lawson et al. | 239/288.5 X |
| 5,037,030 | | 8/1991 | Apodaca | 239/288 |
| 5,211,338 | | 5/1993 | Leite et al. | 239/276 |
| 6,047,897 | * | 4/2000 | Ueno et al. | 239/201 X |

* cited by examiner

*Primary Examiner*—Andres Kashnikow
*Assistant Examiner*—Steven J. Ganey
(74) *Attorney, Agent, or Firm*—Woodard, Emhardt, Naughton, Moriarty & McNett

(57) ABSTRACT

A trim ring is placed around an in-ground lawn sprinkler to discourage grass growth around it and to protect the sprinkler assembly by indicating its location. The sprinkler trim ring comprises two complementary plates, each having a notch or indents which, when assembled, forms a central aperture fitting around a sprinkler body. The overlapped plates are engaged and secured to each other by screws through slots in the upper plate and screwed into the lower plate. The slots permit sliding of the plates to increase or decrease the tightness on the sprinkler body. Grooves are provided on the bottom of both plates allowing breaking off portions to adapt to a larger sprinkler body and/or to installation site limitations.

19 Claims, 4 Drawing Sheets

SPRINKLER TRIM RING

FIELD OF THE INVENTION

This invention relates generally to sprinkler head protective devices, and more particularly to a new and improved sprinkler trim ring adapted to be installed, substantially flush with the ground surface, in a surrounding relationship relative to a sprinkler head for indicating the location of the sprinkler head and for minimizing grass growth around it.

BACKGROUND OF THE INVENTION

A common problem for owners of in-ground sprinkler systems, wherein the underlying piping is completely embedded in the ground with the sprinkler heads rising above ground level, is that grass grows excessively immediately around each of the lawn sprinkler heads. The excessive growth can occur to such a degree that it virtually covers the sprinkler heads and seriously interferes with their proper operation. An added problem of the excessive growth is that the sprinkler heads become hidden and thus are prone to be run over by a lawnmower and be damaged by the wheels or blades of the lawnmower.

Various prior art designs have attempted to overcome the above mentioned problems and such are exemplified in U.S. Pat. No. 2,751,250 to Block, U.S. Pat. No. 3,762,642 to Di Santo, and U.S. Pat. No. 5,211,338 to Leite et. al. The Block Patent discloses an earlier concept wherein a plate assembly is provided in a slight recess in the ground and has slots to enable installing two semi-circular plates around the sprinkler body and under the flange portion of the sprinkler head. U-shaped closure clips keep the installed plates together in place. The Block device is time consuming to install, requiring the soil around a sprinkler head to be dug away a sufficient distance to enable the plates to slide under the flange portion of the sprinkler head. In addition, using the closure clips to lock the plates together is a cumbersome operation.

The Di Santo patent discloses a grass guard comprising two member pieces of which the first piece has a slot in it enabling installation under the top flange of a sprinkler head. The second piece, a slot closer piece, having grooves in the edges is slideably received in the slot to close the ring and complete coverage of the space immediately under the flange. A tongue-in-groove relationship of the slotted piece and the slot closer piece facilitates the alignment. The Di Santo device suffers the disadvantages that the tongue and groove locking mechanism is relatively expensive to manufacture, and that the grooves can trap dirt, thus making the sliding motion difficult.

The Leite patent discloses a sprinkler shield of a single plate construction having a plurality of radial slots extending from a central bore to provide sufficient flexibility to allow the plate to be installed around an existing sprinkler head. Thus, installing the sprinkler shield requires bending the plate and pushing the sprinkler head through the radial slots which can have the undesirable consequence of inadvertently damaging either the sprinkler head, the sprinkler shield, or both.

It may be appreciated therefore that there is a need for a new and improved sprinkler guard which is easy to use, reliable, and can be manufactured at low cost.

SUMMARY OF THE INVENTION

The present invention discloses a trim ring for placing around a sprinkler head to minimize grass growth around it and to help protect a sprinkler head by indicating its location. The sprinkler trim ring comprises two overlapping and complementary members: a slotted member and a screw receiving member, each of which includes an indent. The indents are adapted for fitting partially around a sprinkler head. The slotted member includes at least one slot disposed therethrough. The trim ring is installed by sliding the two complementary members from opposing directions under the flange portion of a sprinkler head such that the slotted member stays on top, and the two indents enclose the sprinkler body. A screw having an enlarged head sized to be retained outside the slot, and a threaded stem sized to be slidingly received through the slot, is inserted through the slot and received in the screw receiving member, and also secures the trim ring to the sprinkler head. The trim ring thus installed is also restricted from upward travel by the extended flange portion of the sprinkler head. The sprinkler trim ring of the present invention is also provided with grooves scored on the surfaces of both members. These grooves enable various portions of the members to be easily separated, thus allowing the trim ring to be custom fit around sprinkler bodies of different sizes and for edge or comer installation.

Accordingly, it is a primary object of the present invention to provide a simple, reliable and inexpensive trim ring for placing around a sprinkler head to discourage grass growth around it and to protect a sprinkler head by indicating its location.

Another object of the present invention is to provide a trim ring which can be easily installed around an existing sprinkler system having sprinkler heads in open lawns and other spatially limited locations.

Still other objects and advantages of the present invention will become readily apparent to those skilled in this art from the following detailed description, wherein only a preferred embodiment of the invention is shown and described, simply by way of illustration of the best mode contemplated of carrying out the invention. As will be realized, the invention is capable of modifications in various obvious respects, all without departing from the invention. Consequently, the drawings and description are to be regarded as illustrative in nature, and not as restrictive.

DETAILED DESCRIPTION OF THE PREFERRED EMBODIMENT

Figure 1:
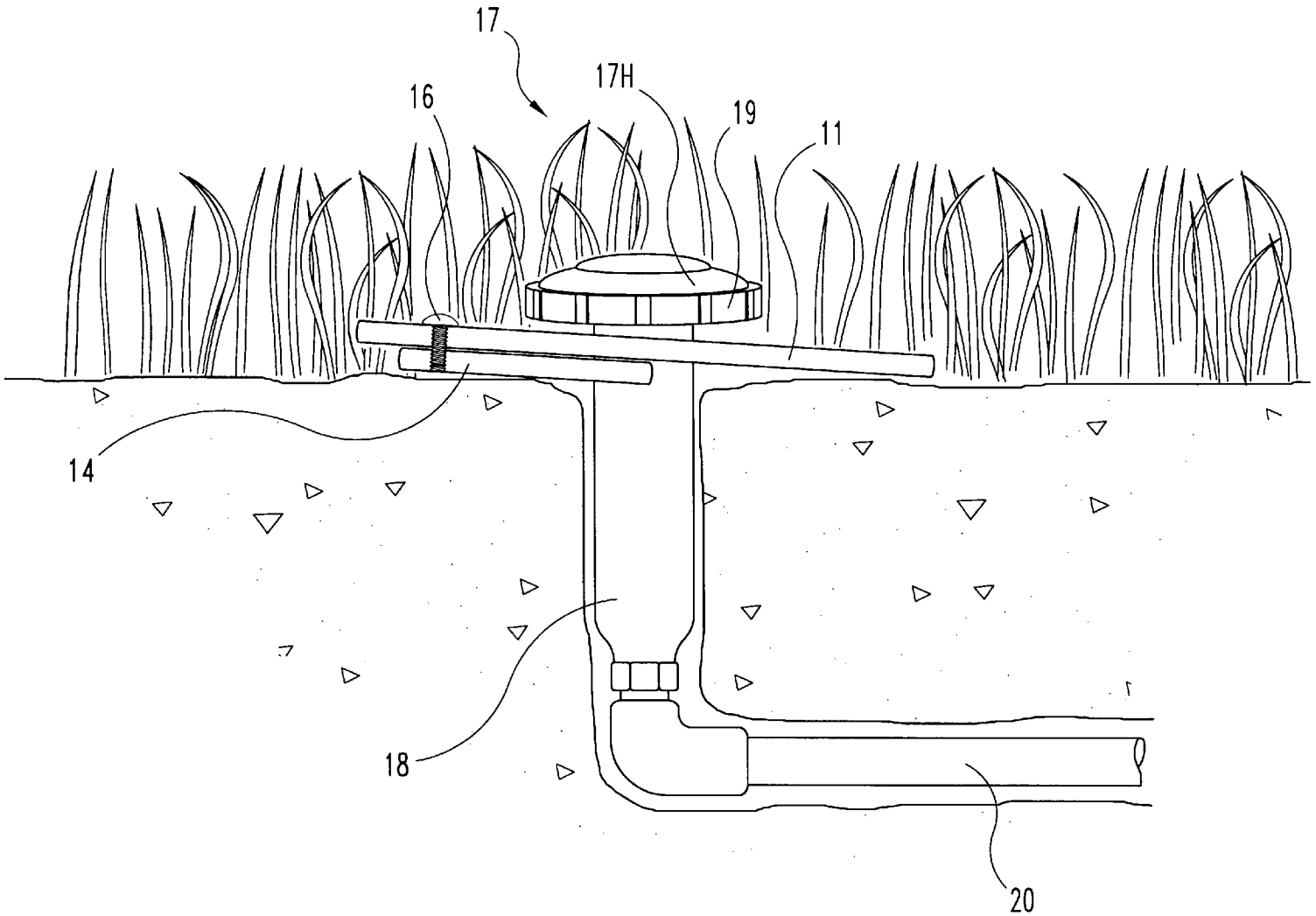
FIG. 1 is a schematic view showing an embodiment of a sprinkler trim ring of the present invention installed around the body of an in-ground sprinkler and being restricted from upward travel by the flange portion of said sprinkler head.

For the purposes of promoting an understanding of the principles of the invention, reference will now be made to the embodiment illustrated in the drawings and specific language will be used to describe the same. It will nevertheless be understood that no limitation of the scope of the invention is thereby intended, such as alterations and further modifications in the illustrated device, and such further applications of the principles of the invention as illustrated therein being contemplated as would normally occur to one skilled in the art to which the invention relates are also included.

The present invention is intended for use with a conventional in-ground sprinkler system in which a sprinkler assembly 17 is secured on the end of an underground water-supply pipe 20. The upper surface of a sprinkler head 17H is generally mounted substantially flush with the ground so as not to interfere with or be damaged by a lawnmower, and for the added reason of not creating a tripping hazard for persons walking on the lawn. Any suitable sprinkler assembly 17 is utilizable herein, including the conventional pop-up sprinkler assembly 17 as shown in FIG. 1. Sprinkler assembly 17 generally has a sprinkler body 18 and a flange portion 19 of sprinkler head 17H screwed onto the sprinkler body 18 and extending laterally therefrom. The sprinkler body 18 and the flange portion 19 generally have a circular periphery; and the flange portion 19 has a larger diameter than sprinkler body 18.

The sprinkler trim ring 10 in accordance with the illustrated embodiment of the present invention comprises two complementary and overlapping members, 11 and 14, engaged by a slot and screw arrangement. Each of the complementary members 11 and 14 includes an indent (28 and 29), which together define a central aperture adapted to receive the sprinkler body 18 when trim ring 10 is assembled. The trim ring is preferably constructed of an UV ray resistant thermoplastic material, for example polypropylene. Thermo-plastic is the material of choice as it imparts adequate rigidity but is still relatively soft and will be less likely to damage lawnmowers inadvertently run over the trim rings 10. Additionally, the material is not subject to rusting. Other materials possessing similar material characteristics, and in whatever color desired, may also be used. Further, the sprinkler trim ring 10 is designed to exert the lowest possible cross sectional profile to avoid interfering with the lawnmower and persons walking on the lawn. Each member, 11 and 14, of trim ring 10 is approximately ¼ inch thick.

Figure 2:
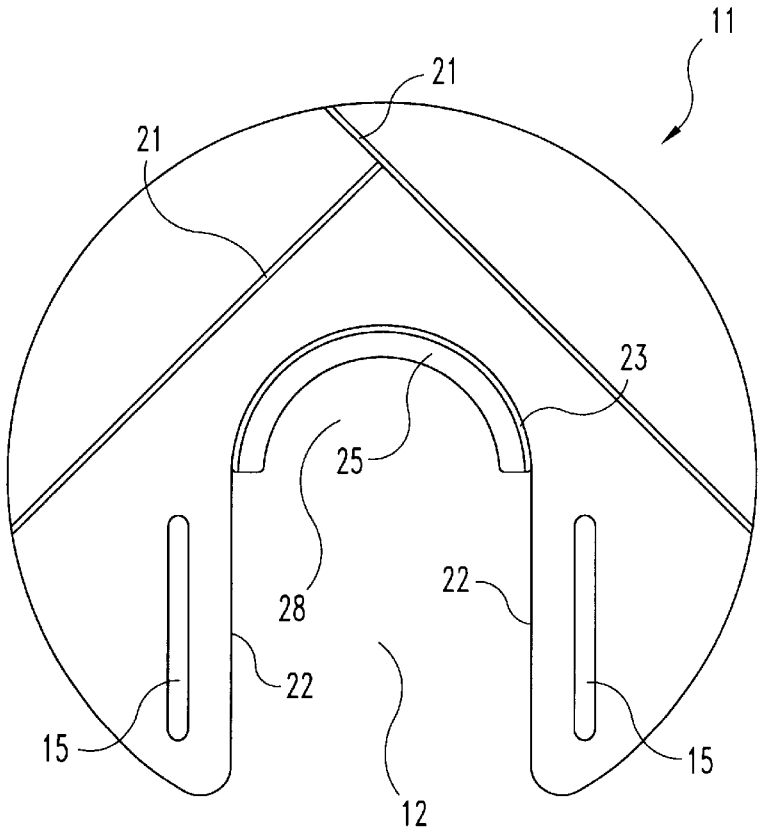
FIG. 2 is the bottom view of the slotted member of an embodiment of the sprinkler trim ring of the present invention.

Referring to FIG. 2, the slotted member 11 is a partially circular thin plate including a first indent 28 and two substantially parallel slots 15 disposed therethrough. First indent 28 is adapted for partially receiving a sprinkler body 18. A concentric groove 23, scored concentrically around the first indent 28 onto a surface, preferably the under surface, of the slotted member 11, enables the edge segment 25 to be separated and thus enlarging the first indent 28 for use with older, or oversized sprinklers. In the illustrated embodiment, only one concentric groove 23 is included. It should be understood that a series of concentric grooves 23 might be employed for added custom fit around variously sized sprinkler bodies 18. Passage 12 communicates the first indent 28 with the exterior of the slotted member 11. Upon installation of the member 11, the sprinkler body 18 passes through this passage 12 and is received into first indent 28. Passage 12 has facing edges 22, preferably parallel, and a minimum width the same as the diameter of the outermost concentric grooves 23. Slots 15, disposed through slotted member 11 at opposing sides of, and preferably in proximity to, edges 22 of passage 12, are adapted to slidingly receive a fastener screw.

Figure 3:
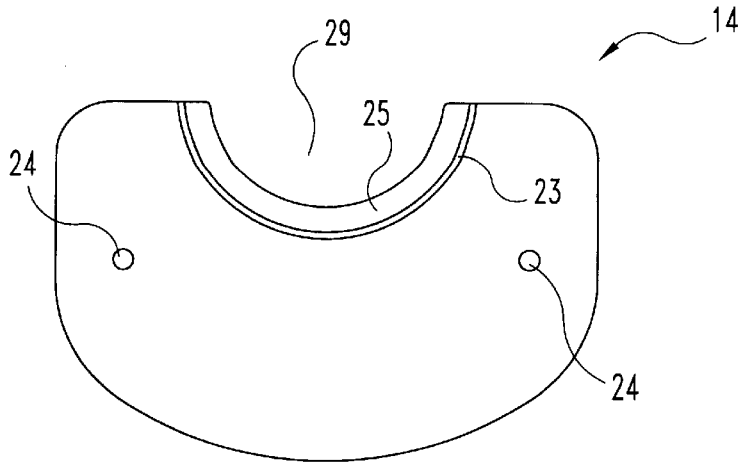
FIG. 3 is the bottom view of the screw-receiving member of an embodiment of the sprinkler trim ring of the present invention.

Referring to FIG. 3, the screw receiving member 14 is also a thin plate including a second indent 29 and two screw receiving holes 24. The second indent 29, complements the geometric shape of first indent 28 of slotted member 11, and is adapted for partially receiving sprinkler body 18. The screw receiving holes 24 are positioned at a distance apart that allows them to align with slots 15. A concentric groove 23, complementary to the concentric groove 23 on slotted member 14 is also provided for easy enlargement of second indent 29.

Figure 4:
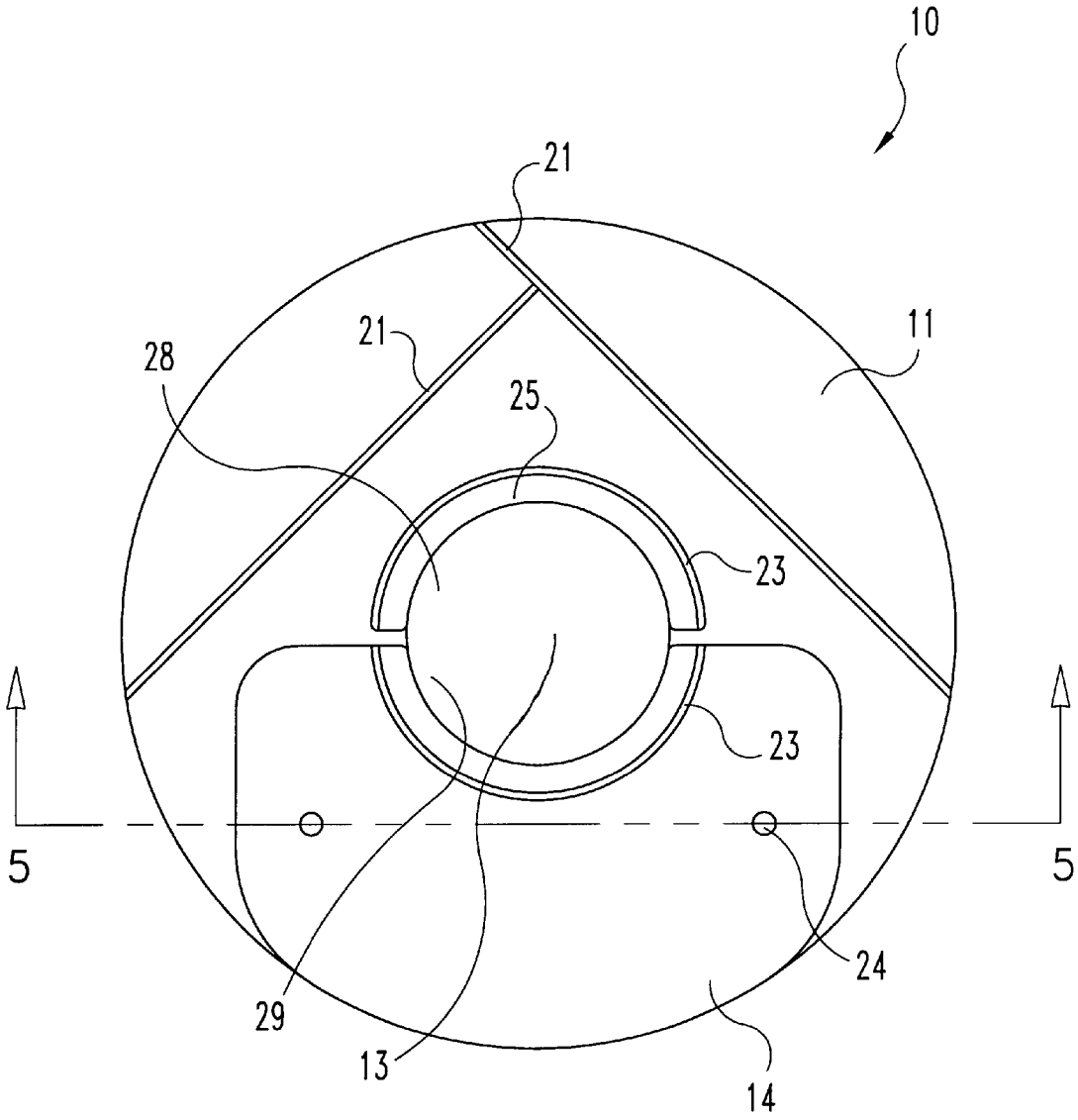
FIG. 4 is the bottom assembled view of an embodiment of the sprinkler trim ring of the present invention.

FIG. 4 shows the underside of an assembled trim ring 10 where slots 15 are aligned with screw receiving holes 24 and where the first indent 28 faces the second indent 29. So oriented, the first and second indents 28 and 29 together define an aperture 13 adapted for receiving the sprinkler body 18.

Figure 5:
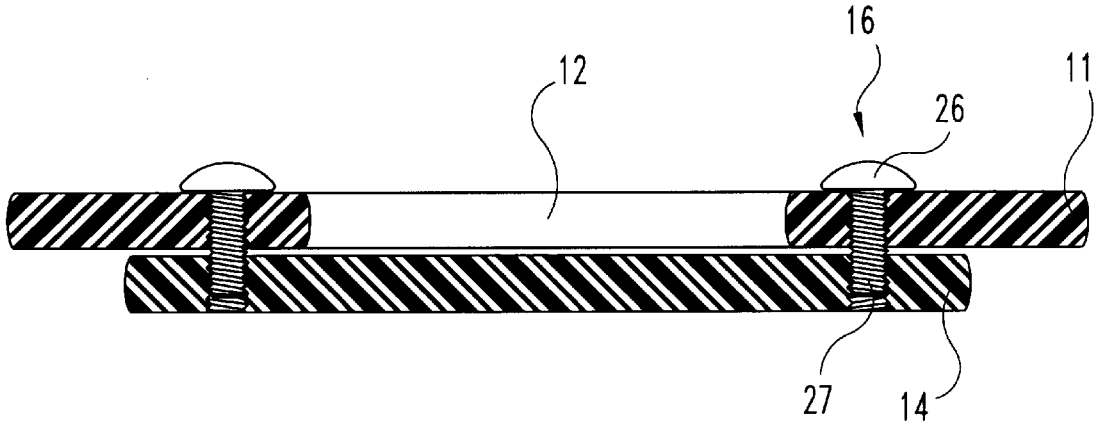
FIG. 5 is a cross sectional view taken along line 5—5 of FIG. 4 of an embodiment of an assembled sprinkler trim ring of the present invention, but inverted to show the normal relationship of the parts in use.

Referring to FIG. 5, fastener screw 16 is a conventional self-tapping screw having an enlarged head 26 and a threaded stem 27. Enlarged head 26 is sized to be retained outside slot 15 while the threaded stem 27 is sized to be slidingly received inside slot 15 and be engagingly received by the screw receiving hole 24. The enlarged head 26 preferably includes an undersurface that is flat for the ease of sliding on slotted member 11. The screw 16 is of adequate length to be capable of engaging the two members 11 and 14 and securing them together.

The sprinkler trim plate 10 is assembled by inserting the screw receiving member 14 from one side of the sprinkler body 18, and the slotted member 11 from the opposite side such that the sprinkler body 18 is completely received into the central aperture 13 and the slots 15 are aligned with the holes 24. The relative position of the two complementary members 11 and 14 is adjusted by sliding the slotted member 11 along the longitudinal axis of slot 15 to obtain an optimal fit around the sprinkler body 18. The fastener screw 16 is finally tightened into screw receiving hole 24 and thus secures slotted member 11 to screw receiving member 14 and retains sprinkler body 18 in the central aperture 13. The sprinkler trim ring 10 so assembled is restricted from moving laterally by the sprinkler body 18 and from moving in an upward direction by the flange portion 19 of sprinkler head 17H (FIG. 1).

It should be understood that, while an embodiment having two slots and tapped holes is illustrated, a single slot and hole arrangement may be used in other embodiments of the present invention, especially where the complementary members 11 and 14 overlap substantially. It should also be understood that screw receiving member 14 may initially include no pre-drilled screw receiving hole. Fastener screw 16 can be driven directly into the screw receiving member 14 to engage and secure the two members, 11 and 14, together; and in doing so, simultaneously creates screw receiving hole 24.

Trim rings 10 are also designed for adaptation to spatially restricted locations. FIG. 2 illustrates a plurality of grooves 21 scored on the bottom of slotted member 11 to facilitate removal of various segments of the member 11 for positioning the sprinkler trim ring 10 relative to lawn or site features such as against a building wall, corner or sidewalk or the like. As illustrated, the straight grooves 21 intersect at approximately a ninety degree angle, which allows for positioning the trim ring 10 around a sprinkler assembly 17 that is located at a straight edge of a lawn or at a comer. Such grooves might also be used in screw receiving member 14, but not as likely due to its relatively small size. Various arrangements of grooves 21 for fitting other spatial restrictions are also contemplated. For example, in addition to straight grooves, concentric outer grooves permitting easy reduction of the outside diameter of the trim ring 10 can be also be included. The depth of scoring should be adequate that the unwanted segments or portions can be easily broken off by hand but not too deep to compromise the structural integrity of the members 12 and 14. In the illustrated embodiment, the straight and concentric grooves 21 and 23 are scored to approximately ⅛ inch deep. In addition, the straight and concentric grooves 21 and 23, respectively, are preferably scored on the underside of the members for visual aesthetics, since otherwise the grooves 21 and 23 could trap soil and dirt, thus detracting from the pleasing uniform look of the trim rings 10.

The foregoing description illustrates a substantially circular trim ring adapted for receiving a sprinkler with generally circular periphery. It is to be understood that the present invention contemplates other geometric shaped trim rings that have functional utilities. The first and second indents, 28 and 29, can also be reshaped to receive any geometric shaped sprinkler body 18.

While the invention has been illustrated and described in detail in the drawings and foregoing description, these are to be considered as illustrative and not restrictive in character, it being understood that only one preferred embodiment has been shown and described and that all changes and modifications that come within the spirit of the invention are desired to be protected.

What is claimed is:

1. A trim ring for an in-ground sprinkler comprising:

a slotted member including at least one slot and a first indent and wherein said first indent is adapted to fit partially around a sprinkler;

a screw receiving member including a second indent and wherein said second indent complements said first indent and is adapted to fit partially around said sprinkler;

a fastener screw having an enlarged head and a threaded stem, wherein said enlarged head is sized larger than said at least one slot, and wherein said threaded stem is sized to be slidingly received in said slot and engagingly received by said screw receiving member;

wherein said slotted member is adapted to overlap said screw receiving member with said at least one slot covering said screw receiving member and said first indent facing said second indent thereby defining an aperture for receiving said sprinkler, and said fastener screw inserted through said slot and received by said screw receiving member securing said slotted member and said screw receiving member together.

2. The trim ring of claim 1 and wherein said slotted member and said screw receiving member have complementary partially circular peripheries so that, when assembled, said trim ring is substantially circular.

3. The trim ring of claim 1 wherein said screw receiving member includes at least one screw receiving hole.

4. The trim ring of claim 3 and wherein said at least one slot is aligned with said at least one screw receiving hole.

5. The trim ring of claim 1 wherein said slotted member includes two slots which are in substantially parallel alignment.

6. The trim ring of claim 5 wherein said screw receiving member includes two screw receiving holes spaced at a distance apart that allows alignment with said slots.

7. The trim ring of claim 1 wherein said slotted member and said screw receiving member are constructed from a UV resistant, thermoplastic material.

8. The trim ring of claim 1 wherein said slotted member and said screw receiving member are plates approximately ¼ a inch thick.

9. The trim ring of claim 1 wherein said slotted member further includes a concentric groove scored around said central aperture thereby dividing said slotted member into a central portion and an edge portion and thereby enabling said edge portion to be separated.

10. The trim ring of claim 9 wherein said concentric groove is scored to a depth of approximately ⅛ inches.

11. The trim ring of claim 1 wherein said slotted member further includes substantially straight grooves dividing said slotted member into a central portion and edge portions and thereby enabling said edge portions to be separated from said central portion for custom fitting of said trim ring in spatially restricted locations.

12. The trim ring of claim 11 wherein said substantially straight grooves are scored to a depth of approximately ⅛ inches.

13. A sprinkler trim ring assembly comprising:

a sprinkler assembly mounted to a water-supply pipe, wherein said water-supply pipe is embedded in the ground and said sprinkler assembly has an upper surface substantially flush with ground level, and wherein said sprinkler assembly comprises a sprinkler body and a sprinkler head having a flange portion of a larger diameter than said sprinkler body;

a slotted member including at least one slot and a first indent and wherein said first indent fits partially around said sprinkler assembly;

a screw receiving member including a second indent and wherein said second indent complements said first indent and fits partially around said sprinkler assembly;

a fastener screw having an enlarged head and a threaded stem, wherein said enlarged head is sized larger than said at least one slot, and wherein said threaded stem is adapted to be slidingly received in said slot and engagingly received by said screw receiving member;

wherein said slotted member and said screw receiving member are under said sprinkler head and around said sprinkler body and have said at least one slot covering said screw receiving member and said first indent facing said second indent, thereby completely enclosing said sprinkler body in an aperture defined by said first and second indents, and said fastener screw is received through said slot and engagingly received by said screw receiving member thereby securing said slotted member and said screw receiving member together, and restricting lateral and upward movement of said trim ring.

14. The assembly of claim 13 wherein said screw receiving member includes at least one screw receiving hole in alignment with said at least one slot.

15. The assembly of claim 13 wherein said slotted member includes two slots which are in substantially parallel alignment.

16. The assembly of claim 15 wherein said screw receiving member includes two holes spaced at a distance apart that allows alignment with said slots.

17. The assembly of claim 13 wherein said slotted member and said screw receiving member are plates approximately ¼ inch thick and constructed from a UV resistant, thermoplastic material.

18. The assembly of claim 13 wherein said slotted member and screw receiving members further include grooves whereby allowing breaking off portions of said slotted member and said screw receiving member to adapt to a larger sprinkler body and/or to installation site limitations.

19. The assembly of claim 18 wherein said grooves are scored to a depth of approximately ⅛ inches.

* * * * *